US011633950B2

(12) United States Patent
Iwata

(10) Patent No.: US 11,633,950 B2
(45) Date of Patent: Apr. 25, 2023

(54) IMAGE FORMING APPARATUS, DROPLET DISCHARGE CONTROL METHOD, AND STORAGE MEDIUM

(71) Applicant: Junichi Iwata, Kanagawa (JP)

(72) Inventor: Junichi Iwata, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 19 days.

(21) Appl. No.: 17/188,703

(22) Filed: Mar. 1, 2021

(65) Prior Publication Data

US 2021/0276326 A1 Sep. 9, 2021

(30) Foreign Application Priority Data

Mar. 4, 2020 (JP) ..... JP2020-037291

(51) Int. Cl.
*B41J 2/045* (2006.01)

(52) U.S. Cl.
CPC ..... *B41J 2/04581* (2013.01); *B41J 2/04568* (2013.01); *B41J 2/04588* (2013.01)

(58) Field of Classification Search
CPC ..... B41J 2/04581
See application file for complete search history.

(56) References Cited

U.S. PATENT DOCUMENTS

2001/0040595 A1* 11/2001 Taki ..... B41J 2/04593 347/14
2003/0071138 A1* 4/2003 Usuda ..... G02B 3/0012 239/548
2005/0270318 A1* 12/2005 Noda ..... B41J 2/0459 347/10
2007/0070102 A1* 3/2007 Takata ..... B41J 2/04541 347/10
2009/0117261 A1* 5/2009 Sakai ..... B41J 2/14233 700/283
2009/0244135 A1* 10/2009 Kaieda ..... B41J 2/04588 347/10
2012/0007906 A1* 1/2012 Zhang ..... B41J 2/0459 347/14

(Continued)

FOREIGN PATENT DOCUMENTS

JP 2006-076286 3/2006
JP 2007-015127 1/2007

(Continued)

*Primary Examiner* — Shelby L Fidler
(74) *Attorney, Agent, or Firm* — Duft & Bornsen, PC

(57) ABSTRACT

An image forming apparatus includes: a piezoelectric element with a common electrode on one side and an individual electrode on another side; a nozzle; and circuitry. The circuitry selects one from drive signals and supplies the one drive signal to the piezoelectric element via the individual electrode, to discharge a droplet through the nozzle to form an image. Each drive signal includes waveform pulses including a main pulse that rises in a slope shape during a rising time and finishes rising at an end time. The circuitry generates the drive signals so that the end time of a less influential drive signal other than a most influential drive signal falls within a range of the rising time of the main pulse of the most influential drive signal; selects the one drive signal based on an image to be formed; and supplies the one drive signal to the piezoelectric element.

8 Claims, 11 Drawing Sheets

(56) References Cited

U.S. PATENT DOCUMENTS

| | | | | |
|---|---|---|---|---|
| 2012/0242727 | A1* | 9/2012 | Zhang | B41J 2/04588 347/11 |
| 2017/0001434 | A1* | 1/2017 | Makita | B41J 2/04586 |
| 2017/0253033 | A1 | 9/2017 | Masui | |
| 2018/0099510 | A1* | 4/2018 | Niino | B41J 2/2146 |
| 2018/0272709 | A1 | 9/2018 | Iwata et al. | |
| 2019/0358953 | A1 | 11/2019 | Iwata et al. | |

FOREIGN PATENT DOCUMENTS

| | | |
|---|---|---|
| JP | 2009-241345 | 10/2009 |
| JP | 2010-173275 | 8/2010 |
| JP | 2013-052608 | 3/2013 |
| JP | 2016-055549 | 4/2016 |
| JP | 2016-088084 | 5/2016 |
| JP | 2016-175337 | 10/2016 |
| JP | 2017-159643 | 9/2017 |
| JP | 2018-199316 | 12/2018 |

* cited by examiner

IMAGE FORMING APPARATUS, DROPLET DISCHARGE CONTROL METHOD, AND STORAGE MEDIUM

CROSS-REFERENCE TO RELATED APPLICATION

This patent application is based on and claims priority pursuant to 35 U.S.C. § 119(a) to Japanese Patent Application No. 2020-037291, filed on Mar. 4, 2020, in the Japan Patent Office, the entire disclosure of which is hereby incorporated by reference herein.

BACKGROUND

Technical Field

Embodiments of the present disclosure relate to an image forming apparatus, a method of controlling droplet discharge, and a storage medium storing program code.

Related Art

In recent years, there has been known inkjet printers that output electronic information. In the case of an inkjet printer, ink is discharged from a recording head onto a recording medium such as a sheet of paper to form an image.

As an ink discharge control method in a recording head, there are known a piezoelectric element method using a piezoelectric element, a thermal (bubble) method in which ink is heated to generate bubbles and the ink is discharged by the pressure, and the like. The recording head using such a discharge control method facilitates implementation of high density multiple nozzles. Accordingly, a high-definition image can be formed on a recording medium.

In an inkjet printer, a piezoelectric element for driving each nozzle correspond to a load on a circuit. The load increases as the number of piezoelectric elements to be driven and the number of pulses per unit time for driving each piezoelectric element increase. In particular, when many loads are driven simultaneously, a large instantaneous current consumption occurs. When such a large current consumption occurs, the waveform of the drive pulse applied to the piezoelectric element is distorted, ink droplets are not appropriately discharged, and printing quality is degraded.

SUMMARY

According to an aspect of the present disclosure, there is provided an image forming apparatus that includes a piezoelectric element with a common electrode on one side and an individual electrode on another side, a nozzle, and circuitry. The circuitry selects one drive signal from a plurality of drive signals and supplies the one drive signal to the piezoelectric element via the individual electrode, to drive the piezoelectric element to discharge a droplet through the nozzle to form an image. Each drive signal includes a plurality of waveform pulses. The plurality of waveform pulses includes a main pulse that rises in a slope shape during a rising time and finishes rising at an end time. The circuitry generates the plurality of drive signals so that the end time of a less influential drive signal other than a most influential drive signal among the plurality of drive signals falls within a range of the rising time of the main pulse of the most influential drive signal; selects the one drive signal based on an image to be formed; and supplies the one drive signal to the piezoelectric element.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1A:
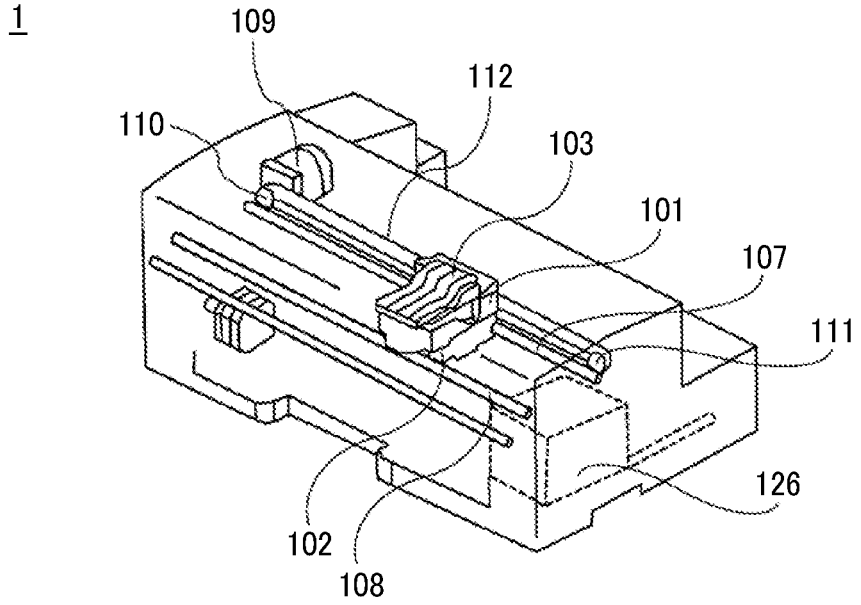
FIGS. 1A and 1B are diagrams illustrating an overall configuration of an inkjet printer according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Hereinafter, an inkjet printer according to an embodiment is described with reference to the accompanying drawings.

First Embodiment

Overall Configuration

Figure 1B:
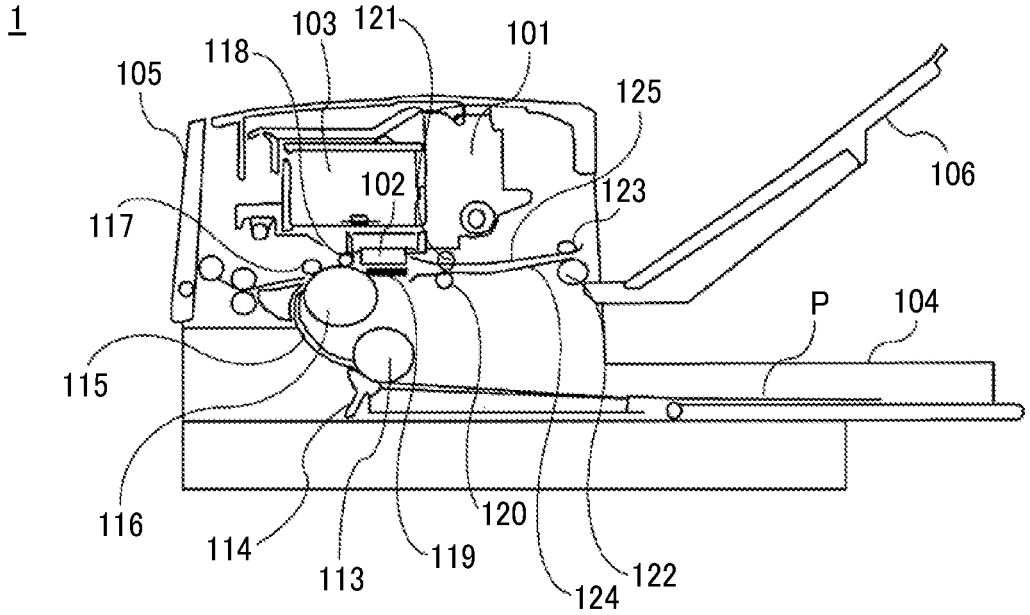

FIGS. 1A and 1B are diagrams illustrating an overall configuration of an inkjet printer 1 according to a first embodiment. FIG. 1A is a perspective view of the inkjet printer 1 illustrated in a state in which the inside of the inkjet printer 1 is transparent. FIG. 1B is a side view of the inkjet printer 1 illustrated in a state in which the inside of the inkjet printer 1 is transparent.

As illustrated in FIGS. 1A and 1B, the inkjet printer 1 according to the first embodiment includes, for example, a printing mechanism. The printing mechanism includes, for example, a carriage 101, recording heads 102, and ink cartridges 103. The carriage 101 is movable in a main scanning direction. The recording heads 102 are mounted on the carriage 101. The ink cartridges 103 supply ink to the recording heads 102.

A sheet feed cassette (or a sheet feed tray) 104 capable of loading recording media such as a large number of sheets P from the front side can be detachably attached to a lower portion of an apparatus body of the inkjet printer 1. At the lower portion of the apparatus body of the inkjet printer 1, a bypass feed tray (or manual feed tray) 105 for a user to manually feed the sheet P is disposed to be openable.

The inkjet printer 1 takes in a sheet P fed from the sheet feed cassette 104 or the bypass feed tray 105, records a desired image on the sheet P by the printing mechanism, and ejects the sheet P to a sheet ejection tray 106 mounted on the rear side of the apparatus body. Note that the sheet P (as a recording medium) is not limited to a plain sheet of paper and may be any other object such as a film or a sheet-shaped material of plastic or the like, as long as the object can be a target on which an image is formed and output.

The printing mechanism includes a main guide rod 107 and a sub-guide rod 108 as guides laterally bridged between left and right side plates. The main guide rod 107 and the sub-guide rod 108 support the carriage 101 slidably in the main scanning direction (in other words, a direction perpendicular to a plane on which FIG. 1B is drawn). The recording heads 102 on the carriage 101 discharges ink droplets of different colors of yellow, cyan, magenta, and black. A plurality of ink discharge ports for discharging the inks of the respective colors are arranged in a direction intersecting the main scanning direction, and the ink discharge ports are directed downward.

Ink cartridges 103 that supply inks of the respective colors to the recording heads 102 are replaceably mounted in the carriage 101. Each of the ink cartridges 103 has an atmosphere communication port, a supply port, and a porous body. The atmosphere communication port is disposed at an upper portion of the ink cartridge 103 to communicate with the atmosphere. The supply port is disposed at a lower portion of the ink cartridge 103 to supply ink to the recording head 102. The porous body is disposed inside the ink cartridge 103 to be filled with ink. Ink to be supplied to the recording head 102 is kept at a slight negative pressure by capillary force of the porous body. In the present embodiment, the case in which the recording heads 102 are provided for the respective colors is described as an example. However, in some embodiments, a single head having nozzles for discharging inks of the different colors may be used.

The rear side (i.e., the downstream side in the sheet conveyance direction) of the carriage 101 is slidably mounted on the main guide rod 107. The front side (i.e., the upstream side in the sheet conveyance direction) of the carriage 101 is slidably mounted on the sub-guide rod 108. In order to move and scan the carriage 101 in the main scanning direction, a timing belt 112 is stretched between a driving pulley 110 and a driven pulley 111. The driving pulley 110 is driven and rotated by a main scanning motor 109. The timing belt 112 and the carriage 101 are fixed to each other. The carriage 101 is driven and reciprocated by forward rotation and reverse rotation of the main scanning motor 109.

On the other hand, in order to convey sheets P set in the sheet feeding cassette to the lower side of the recording head 102, a sheet feeding roller 113 and a friction pad 114 are provided to separate and feed the sheets P one by one from the sheet feeding cassette 104. The inkjet printer 1 further includes a guide member 115 to guide the sheet P, a conveyance roller 116 to reverse and convey the fed sheet P, a conveyance roller 117 pressed against the circumferential surface of the conveyance roller 116, and a leading end roller 118 to define the feed angle of the sheet P from the conveyance roller 116. The conveyance roller 116 is driven and rotated by a sub-scanning motor via a gear train.

The inkjet printer 1 further includes a print receiver 119 disposed below the recording heads 102. The print receiver 119 is a sheet guide to guide the sheet P, which is fed from the conveyance roller 116, in a range corresponding to a range of movement of the carriage 101 in the main scanning direction. On the downstream side of the print receiver 119 in the sheet conveyance direction, the inkjet printer 1 includes a conveyance roller 120, a spur roller 121, a sheet ejection roller 122, a spur roller 123, a guide 124, and a guide 125. The conveyance roller 120 is driven to rotate with the spur roller 121 to feed the sheet P in a sheet ejection direction. The sheet ejection roller 122 and the spur roller 123 further feed the sheet P to the sheet ejection tray 106. The guide 124 and the guide 125 form a sheet ejection path.

When an image is recorded on the sheet P, a controller of the inkjet printer 1 drives the recording heads 102 in accordance with image signals while moving the carriage 101 and discharges ink onto the stopped sheet P to record one line of an image by one scan. After the sheet P is conveyed by a predetermined amount, the next line is recorded. In response to a recording end signal or a signal indicating that the rear end of the sheet P has reached a recording area, the recording operation is ended and the sheet P is ejected.

The recording head 102 includes a plurality of piezoelectric elements as driving elements, respectively, to drive the plurality of nozzles provided as described above. In other words, in the inkjet printer 1 according to the first embodiment, the piezoelectric elements are used as actuator elements to generate discharge force for discharging ink (droplets) from the respective nozzles. Applying a predetermined drive waveform to each piezoelectric element causes ink to be discharged from each nozzle.

A maintenance recovery device 126 that recovers discharge failures of the recording heads 102 is disposed at a position outside a recording area in an end (right end in FIG. 1B) in the direction of movement of the carriage 101. The maintenance recovery device 126 includes a capping unit, a suction block (a suction unit), and a cleaning unit. The carriage 101 is moved to the side of the maintenance recovery device 126 in a printing standby state. Then, the recording heads 102 are capped with the capping unit. Accordingly, the discharge port unit is kept in a wet state and discharge failure due to ink drying is prevented.

For example, during recording, the recording head 102 discharges ink not relating to the recording to the maintenance recovery device 126 to maintain the viscosity of ink in all of the discharge ports constant, thus maintaining stable discharging performance. For example, in the case in which a discharge failure occurs, the cap unit seals the discharge ports (nozzles) of the recording heads 102, the suction unit sucks air bubbles and the like from the discharge ports by the suction unit through a tube, and the ink, dust, and the like adhering to a discharge port surface are removed by the cleaning unit to recover the discharge failure. The sucked ink is drained to a waste ink container at a lower portion of the apparatus body, and is absorbed into and retained in an ink absorber of the waste ink container.

Functional Configuration of Inkjet Printer

Figure 2:
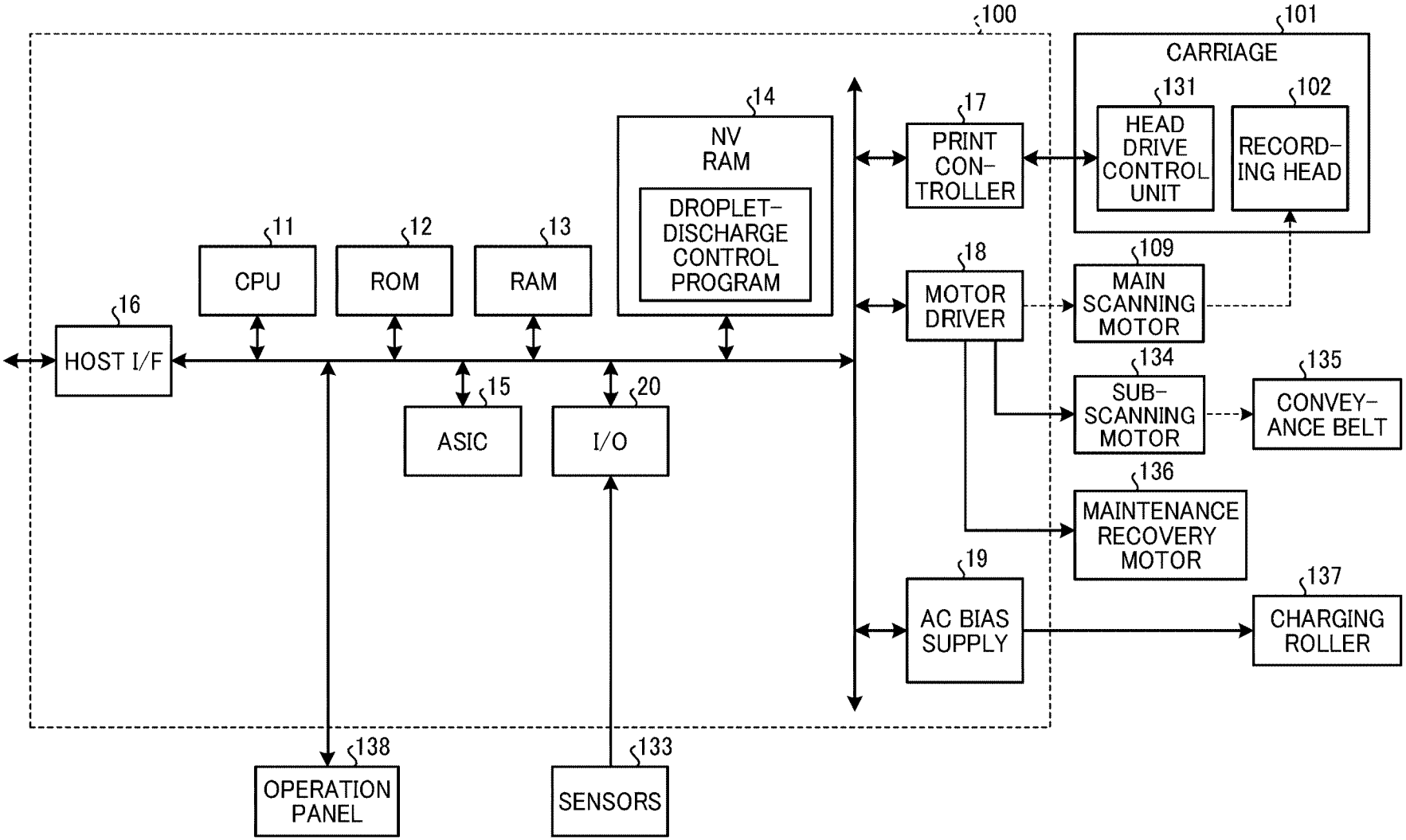
FIG. 2 is a block diagram illustrating a functional configuration of the inkjet printer according to the first embodiment.

FIG. 2 is a block diagram illustrating a functional configuration of the inkjet printer 1 according to the first embodiment. As illustrated in FIG. 2, the inkjet printer 1 includes the controller 100, the carriage 101, the main scanning motor 109, a group of sensors 133, a conveyance belt 135, a maintenance recovery motor 136, a charging roller 137, and an operation panel 138.

The operation panel 138 is a user interface that functions as an operation unit and a display unit for inputting and displaying information necessary for the inkjet printer 1. The carriage 101 is provided with the recording heads 102 that discharge ink and a head drive control unit 131 that drives the recording heads 102. The carriage 101 is moved in the main scanning direction that is a direction perpendicular to a sub-scanning direction that is a conveyance direction of the sheet with respect to the sheet conveyed by the conveyance belt 135. Thus, ink is discharged to the upper side of the sheet to form and output an image.

The main scanning motor 109 is a motor that supplies power for moving the carriage 101 in the main scanning direction. The sub-scanning motor 134 is a motor that supplies power to the conveyance belt 135 that conveys a sheet as an image output target. The maintenance recovery motor 136 is a motor that drives the maintenance recovery device 126.

The group of sensors 133 includes various sensors to detect various types of information in the inkjet printer 1, such as a rotation detection sensor to detect rotation of the main scanning motor 109 and the sub-scanning motor 134, an optical sensor to detect the position of a sheet, a thermistor to monitor the temperature in the inkjet printer 1, a sensor to monitor the voltage of a charging belt, and an interlock switch to detect opening and closing of a cover. The charging roller 137 charges the conveyance belt 135 to generate an electrostatic force for causing the conveyance belt 135 to attract a sheet as the image output target to the conveyance belt.

The controller 100 is a control device or circuitry to control operations of the inkjet printer 1. As illustrated in FIG. 2, the controller 100 includes a central processing unit (CPU) 11, a read only memory (ROM) 12, a random access memory (RAM) 13, a nonvolatile random access memory (NVRAM) 14, an application-specific integrated circuit (ASIC) 15, a host interface (I/F) 16, a print controller 17, a motor driver 18, an alternating-current (AC) bias supply 19, and an input-and-output (I/O) unit 20.

The CPU 11 controls operations of units of the controller 100. The ROM 12 is a nonvolatile read-only storage medium and stores programs such as firmware. The RAM 13 is a volatile storage medium that allows data to be read and written at high speed. The CPU 11 uses the RAM 13 as a work area for data processing. The NVRAM 14 is a nonvolatile storage medium that allows data to be read and written information, and stores control programs and parameters for control.

The ASIC 15 is a hardware circuit that executes image processing necessary for image formation and output. The host I/F 16 is an interface for receiving drawing data from a host device such as a personal computer (PC). For example, Ethernet (registered trademark) or a universal serial bus (USB) interface is used as the host I/F 16. The I/O 20 is a port for inputting detection signals from the group of sensors 133 to the controller 100.

The print controller 17 includes a data transfer unit to drive and control the recording head 102 included in the carriage 101, and a drive waveform generation unit to generate drive waveforms. The motor driver 18 drives the main scanning motor 109 and the sub-scanning motor 134. The AC bias supply 19 supplies an AC bias to the charging roller 137.

For example, drawing data from a host such as an information processor such as a PC, an image reader such as an image scanner, or an imaging device such as a digital camera are input to the host I/F 16 in the controller 100 and stored in a reception buffer in the host I/F 16. The CPU 11 performs calculations in accordance with a program loaded in the RAM 13 to read and analyze the print data in the reception buffer included in the host I/F 16, and controls the ASIC 15 to perform necessary image processing and rearrangement processing of data. The CPU 11 controls the print controller 17 to transfer the drawing data processed in the ASIC 15 to the head drive control unit 131.

The print controller 17 transfers the above-described drawing data to the head drive control unit 131 as serial data, and outputs a transfer clock, a latch signal, a droplet control signal (mask signal), and the like necessary for transfer of the drawing data, confirmation of the transfer, and the like to the head drive control unit 131. The print controller 17 includes a drive waveform generation unit and a drive waveform selection unit. The drive waveform generation unit includes a digital-to-analog (D/A) convertor, a voltage amplifier, and a current amplifier. The digital-to-analog (D/A) convertor converts pattern data of a drive signal stored in the ROM 12 from digital data to analog data. The drive waveform selection unit supplies the converted data to the head drive control unit 131. The print controller 17 generates a drive waveform including one or more drive pulses (drive signals) and outputs the drive waveform to the head drive control unit 131.

The head drive control unit 131 selectively applies drive signals constituting the drive waveform given from the print controller 17 to a drive element that generates energy for discharging droplets from the recording head 102 based on drawing data for one line that is serially input. At this time, the head drive control unit 131 selects the drive pulses constituting the drive waveform to selectively discharge dots of different sizes such as a large droplet (large dot), a medium droplet (medium dot), and a small droplet (small dot).

Figure 3:
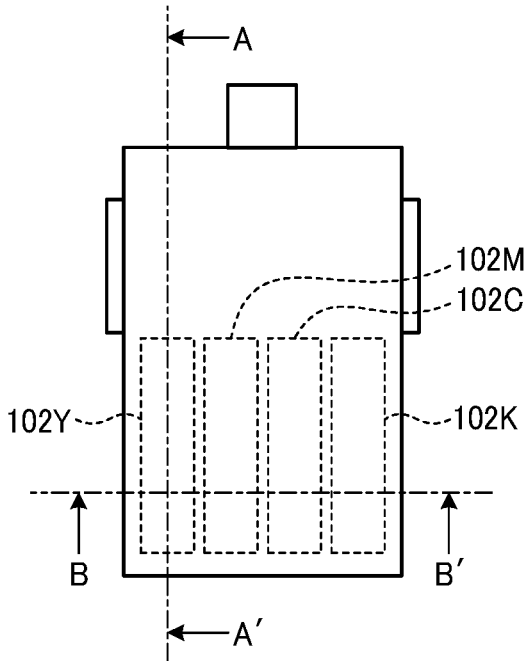
FIG. 3 is a diagram illustrating a configuration of recording heads in a carriage of the inkjet printer according to the first embodiment.

Here, the configuration of the recording heads 102 in the carriage 101 is described. FIG. 3 is a diagram schematically illustrating the recording heads 102 in the carriage 101 according to the present embodiment. As illustrated in FIG. 3, the carriage 101 according to the present embodiment is provided with recording heads 102K, 102C, 102M, and 102Y as the recording heads 102 for respective colors of cyan (C), magenta (M), yellow (Y), and black (K).

Figure 4A:
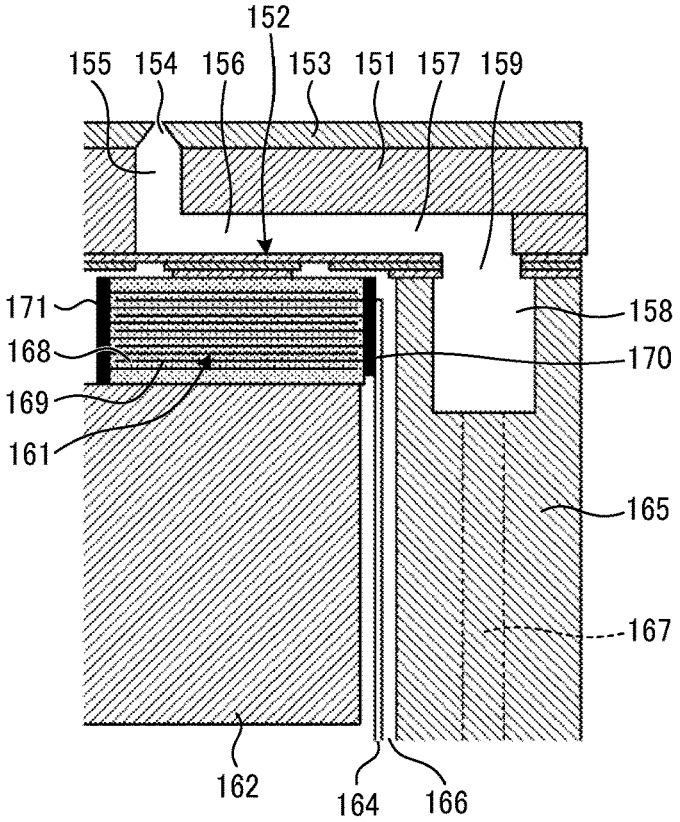
FIG. 4A is a cross-sectional view of one recording head taken along line A-A' of FIG. 3.
Figure 4B:
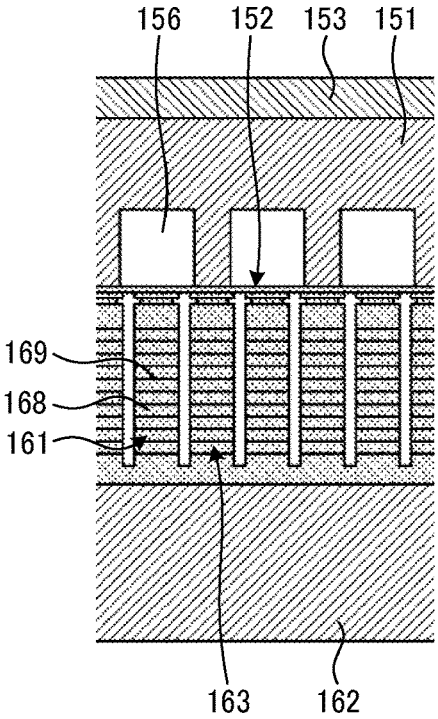
FIG. 4B is a cross-sectional view of recording heads taken along line B-B' of FIG. 3.

FIG. 4A is a cross-sectional view of one recording head 102 taken along line A-A' of FIG. 3. FIG. 4B is a cross-sectional view of recording heads 102 taken along line B-B' of FIG. 3. As illustrated in FIGS. 4A and 4B, the recording head 102 includes a channel plate 151, a diaphragm plate 152, and a nozzle plate 153 that are bonded and laminated one on another. The channel plate 151 is formed by anisotropically etching, for example, a single crystal silicon substrate. The diaphragm plate 152 is bonded to the lower surface of the channel plate 151 and formed by, for example, nickel electroforming. The nozzle plate 153 is bonded to the upper surface of the channel plate 151. Thus, a nozzle communication channel 155, a liquid chamber 156, an ink supply port 159, and the like are formed. The nozzle communication channel 155 is a channel through which a nozzle 154 to discharge liquid droplets (ink droplets) communicates. The liquid chamber 156 is a pressure generation chamber. The ink supply port 159 communicates with a common liquid chamber 158 to supply ink to the liquid chamber 156 through a fluid restrictor (supply channel) 157.

The recording head 102 includes two rows of laminated piezoelectric elements 161 and a base substrate 162. The laminated piezoelectric elements 161 as electromechanical transducer elements are pressure generation units (actuator units) to deform the diaphragm plate 152 to pressurize ink in the liquid chambers 156. The piezoelectric elements 161 are bonded and fixed to the base substrate 162. Support portions 163 are provided between the piezoelectric elements 161. When a piezoelectric element member is divided and processed, the support portions 163 are formed at the same time as the piezoelectric elements 161. The support portions 163 are simple supports since no drive voltage is applied to the support portions 163.

Flexible printed circuit cables 164 including driving ICs are connected to the piezoelectric elements 161. A peripheral edge portion of the diaphragm plate 152 is joined to a frame member 165. The frame member 165 forms a through portion 166 to accommodate an actuator unit including the piezoelectric element 161 and the base substrate 162, a concave portion serving as the common liquid chamber 158, and an ink supply hole 167 to supply ink from the outside to the common liquid chamber 158.

The nozzle plate 153 includes nozzles 154, each of which has a diameter of 10 to 30 μm, for example, and corresponds to each liquid chamber 156. The nozzle plate 153 is bonded to the channel plate 151 with an adhesive. The nozzle plate 153 includes a nozzle formation member formed of a metal member. A water repellent layer is formed on the outermost surface of the nozzle formation member via a desired layer.

The piezoelectric element 161 is a laminated piezoelectric element in which piezoelectric materials 168 and internal electrodes 169 are alternately laminated. As an example, a PZT ($PbZrO_3$—$PbTiO_3$) element can be used as the piezoelectric element 161. An individual electrode 170 and a common electrode 171 are connected to each of the internal electrodes 169 that are led out to alternately different end surfaces of the piezoelectric element 161. In the example of the first embodiment, the piezoelectric element 161 pressurizes ink in the liquid chamber 156, using upward displacement in FIG. 4A. In some embodiments, for example, a single row of piezoelectric elements 161 may be provided on one base substrate 162.

In the recording head 102 thus configured, for example, the voltage applied to the piezoelectric element 161 is decreased from the reference potential. Accordingly, the piezoelectric element 161 contracts, the diaphragm plate 152 descends, the volume of the liquid chamber 156 expands, and ink flows into the liquid chamber 156. Then, the voltage applied to the piezoelectric element 161 is increased. Accordingly, the piezoelectric element 161 extends in the lamination direction, the diaphragm plate 152 deforms toward the nozzle 154, and the volume (or capacity) of the liquid chamber 156 contracts. Thus, ink as the recording liquid in the liquid chamber 156 is pressurized and discharged (ejected) as ink droplets from the nozzle 154.

When the voltage applied to the piezoelectric element 161 is returned to the reference potential, the diaphragm plate 152 returns to the initial position. The liquid chamber 156 expands to generate a negative pressure, and the ink is filled into the liquid chamber 156 from the common liquid chamber 158. When the vibration of the meniscus surface of the nozzle 154 is attenuated and stabilized, the operation shifts to the next operation for discharging ink.

Recording Head Including Piezoelectric Element

Here, the recording head 102 using the piezoelectric elements 161 supplies a drive waveform, which is a source of deformation, to the piezoelectric element 161 corresponding to a plurality of nozzles to drive the piezoelectric element 161. Thus, the recording head 102 contacts the volume of the pressure chamber (the liquid chamber 156) and discharges ink filled in the pressure chamber to form a printed image. The piezoelectric element 161 has a Vcom electrode serving as a current supply side on one surface and a com electrode serving as a return side on the opposite surface. The piezoelectric element 161 is driven by a potential difference between the two electrodes with the Vcom electrode being at a drive waveform potential and the com electrode being at a constant potential.

In the print controller 17, waveform data including a pulse composed of a falling edge and a rising edge of a voltage is sent to and amplified by an amplifier to generate the drive waveform. The pulse of the drive waveform corresponds to the contraction of the volume of the pressure chamber. The falling and rising of the voltage are set at the times corresponding to the resonance period of the pressure chamber, thus allowing an efficient discharge operation.

Combining a plurality of pulses of the drive waveform allows a plurality of droplets to be discharged. Merging the plurality of droplets before landing on the medium can change the size of ink droplets and impart gradation expression to a printed image. The plurality of pulses usually include a sub-pulse for controlling the discharge amount and a main pulse for controlling the discharge speed. In many cases, a discharge operation at a desired amount and speed is achieved with such a configuration.

In addition, ink drying can be restrained by minutely contracting the pressure chamber with a pulse having a small amplitude and stirring the pressure chamber. The drive waveform including such pulses can be divided by time and controlled to be transmitted to the piezoelectric element 161 at a timing of a necessary pulse. Such a configuration allows various drive patterns to be supplied to the piezoelectric element 161.

On the other hand, when high-speed printing is performed, the ink discharge cycle (ejection cycle) needs to be shortened. For this reason, the time for including a plurality of pulses in the drive waveform to cover drive patterns necessary for forming the print image may be insufficient.

In such a case, the volume of the pressure chamber is reduced to shorten the resonance period, thus shortening the pulse time of the drive waveform. Alternatively, two amplifier units may be provided to generate drive waveforms of different drive patterns and selectively supply the drive waveforms to the piezoelectric element 161. Thus, a necessary drive pattern can be supplied in accordance with high-speed printing.

However, in the case of a recording head using piezoelectric elements, each piezoelectric element corresponds to a load on a circuit. Therefore, as the number of piezoelectric elements to be driven and the number of pulses per unit time increase, the load also increases. In particular, when many loads are simultaneously driven, a large instantaneous current consumption occurs.

If a recording head has a plurality of piezoelectric elements in which the Vcom side is constituted of the individual electrode and the com side is constituted of the common electrode, the potential variation due to the wiring resistance of the electrode itself occurs in the common electrode in proportion to the current flowing to the com side. When the charging or discharging of the piezoelectric element by the pulse included in the drive waveform ends, the peak of the potential variation takes the maximum value and the slope of the pulse included in the drive waveform reaches the end point. When the drive waveform is simultaneously supplied to many piezoelectric elements, a large amount of current flows through the common electrode (com). The drive waveform potential (Vcom−com) applied to the piezoelectric elements is distorted from the original shape (Vcom) due to potential variation. In such a case, appropriate ink droplets are not discharged, and the print quality deteriorates.

As described above, in the case of the recording head in which two amplifier units are provided and two systems are provided on the Vcom side, the potential variation on the com side is largely influenced by the Vcom side current driven more, and is less influenced by the other Vcom side current driven less. Due to the bias of the load between the Vcoms, the piezoelectric element driven by the Vcom on the low load side is likely to be easily affected by the distortion caused by the potential variation on the com side due to the imbalance of the load state of the Vcom/com. In the description of the present embodiment, the drive signal contributing to the Vcom-side current driven more is described as the "most influential drive signal".

In addition, in a recording head in which the volume of the pressure chamber is reduced to shorten the resonance period, the voltage change width per unit time of the pulse included in the drive waveform is also increased, and the potential variation is likely to occur. In order to solve the disadvantage, there is a method of restraining the voltage variation by providing individual electrodes on the com side in the plurality of piezoelectric elements or by applying counter pulses to the common electrode. However, there are disadvantages such as high difficulty in processing and wiring of the piezoelectric elements and an increase in circuit scale.

Outline of First Embodiment

As described above, the inkjet printer 1 according to the first embodiment includes the recording head 102 in which drive waveform application side electrodes are individually provided on one side and a common electrode having a constant voltage is provided on the opposite side. Each piezoelectric element is driven by two or more different drive waveforms. A current feedback side has one system and a current supply side has multiple systems.

In the case in which the current supply in one system (drive waveform) affects the current feedback side, since there is only one system on the current feedback side, the feedback current in another system (drive waveform) is also affected. Therefore, in the respective shapes of the drive waveforms of the respective systems, portions that strongly affect the current feedback side are made common.

In other words, in order to make the influence of the individual drive waveforms generated by the plurality of amplifier units on the common electrode of the piezoelectric element constant, the portion of each drive waveform shape that strongly affects the common electrode is set to be common. Thus, the influence of the individual drive waveforms on the piezoelectric element constant via the common electrode can be constant, and the adverse effect of different drive waveforms interfering with each other via the common electrode can be avoided.

Such a configuration can obviate the need for processing the piezoelectric element and prevent an increase in the circuit scale. In the recording head 102 in which one type of the electrodes is a common electrode, electrical interference can be reduced when the recording head 102 operates with different drive waveforms of two or more systems. Thus, print quality can be enhanced.

Circuit Configuration

Figure 5:
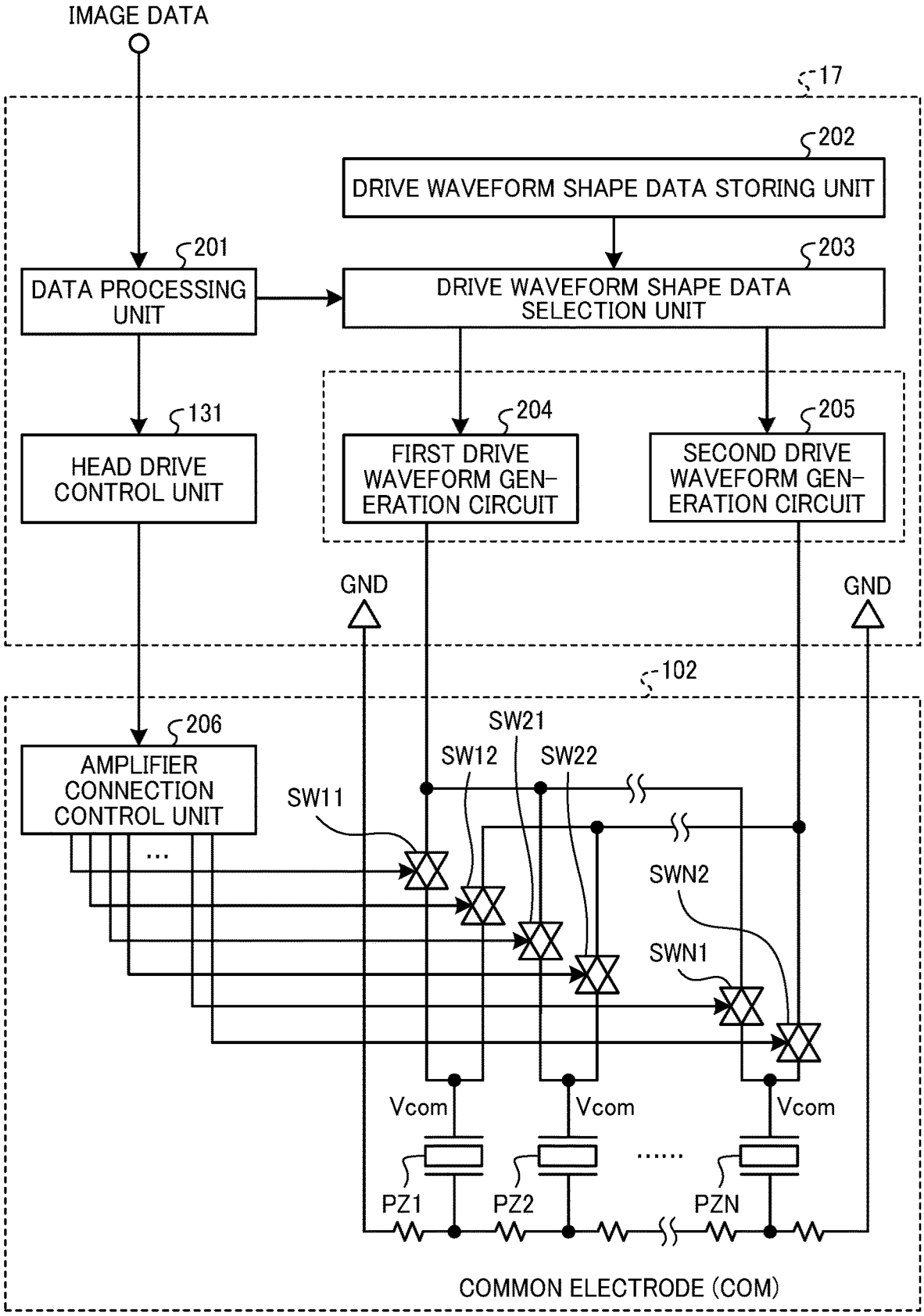
FIG. 5 is a diagram illustrating a circuit configuration of a print controller, a head drive control unit, and a recording head in the inkjet printer according to the first embodiment.

FIG. 5 is a diagram illustrating a circuit configuration of the print controller 17, the head drive control unit 131, and the recording head 102 in the inkjet printer 1 according to the first embodiment. As illustrated in FIG. 5, the print controller 17 includes a data processing unit 201, the head drive control unit 131, a drive waveform shape data storing unit 202, and a drive waveform shape data selection unit 203. The print controller 17 includes two drive waveform generation circuits, i. e., a first drive waveform generation circuit 204 and a second drive waveform generation circuit 205. The first drive waveform generation circuit 204 and the second drive waveform generation circuit 205 are examples of a drive signal generation unit.

The data processing unit 201 supplies selection information for selecting a drive signal to be supplied to each of the piezoelectric elements PZ1 to PZN (N is a positive integer) among the first drive signal generated by the first drive waveform generation circuit 204 and the second drive signal generated by the second drive waveform generation circuit 205, to the drive waveform shape data selection unit 203 based on image information to be printed.

The drive waveform shape data storing unit 202 stores drive waveform shape data for generating the first drive signal and the second drive signal having different waveform shapes. The drive waveform shape data selection unit 203 selects the drive waveform shape data for the first drive signal or the drive waveform shape data for the second drive signal, based on the selection information supplied from the data processing unit 201. When the drive waveform shape data for the first drive signal is selected, the drive waveform shape data selection unit 203 supplies the drive waveform shape data for the first drive signal to the first drive waveform generation circuit 204. When the drive waveform shape data for the second drive signal is selected, the drive waveform shape data selection unit 203 supplies the drive waveform shape data for the second drive signal to the second drive waveform generation circuit 205.

The first drive waveform generation circuit 204 generates the first drive signal based on the drive waveform shape for the first drive signal and supplies the first drive signal to the switches SW11, SW21, . . . , and SWN1 (N is a positive integer) connected to the piezoelectric elements PZ1 to PZN. The second drive waveform generation circuit 205 generates the second drive signal based on the drive waveform shape for the second drive signal and supplies the second drive signal to the switches SW12, SW22, . . . , and SWN2 (N is a positive integer) connected to the piezoelectric elements PZ1 to PZN. The amplifier connection control unit 206 and the switches SW11, SW21, . . . , and SWN1 and the switches SW12, SW22, . . . , and SWN2 are examples of a selection unit.

The head drive control unit 131 determines the piezoelectric element to be driven among the piezoelectric elements PZ1 to PZN based on the image to be printed, and determines the drive signal used for driving the piezoelectric element among the first drive signal and the second drive signal based on the image to be printed. Then, the head drive control unit 131 controls switching of the switches SW11, SW21, . . . , and SWN1 and the switches SW12, SW22, . . . , and SWN2 so that the first drive signal or the second drive signal determined based on the image to be printed is supplied to the piezoelectric element to be driven. Accordingly, the piezoelectric element determined based on the image to be printed is driven by the first drive signal or the second drive signal determined based on the image to be printed, and printing of the image is performed.

In the following description, the head drive control unit 131, the data processing unit 201, and the drive waveform shape data selection unit 203 to the amplifier connection control unit 206 are described as hardware as an example. However, such units may be implemented by software. When implemented by software, as illustrated in FIG. 2, a droplet discharge control program is stored in, for example, a storage device such as the NVRAM 14. Then, the CPU 11 or the like executes the droplet discharge control program to implement the functions of the head drive control unit 131, the data processing unit 201, and the drive waveform shape data selection unit 203 to the amplifier connection control unit 206 by software. Such a configuration can obtain the same effect as when the head drive control unit 131, the data processing unit 201, and the drive waveform shape data selection unit 203 to the amplifier connection control unit 206 are implemented by hardware. For details, refer to the following descriptions.

The droplet discharge control program may be recorded and provided in a computer-readable storage medium such as a compact disc read only memory (CD-ROM) or a flexible disk (FD) as file information in an installable format or an executable format. The droplet discharge control program may be stored and provided in a computer-readable storage medium, such as a compact disc recordable (CD-R), a digital versatile or video disk (DVD), a Blu-ray disc (BD) (registered trademark), or a semiconductor memory. The droplet discharge control program may be provided so as to be installed via a network such as the Internet. The droplet discharge control program may be incorporated in advance and provided in a ROM or the like in an apparatus.

As described above, the drive signal generated by one of the first drive waveform generation circuit 204 and the second drive waveform generation circuit 205 is supplied to each of the piezoelectric elements PZ1 to PZN at a predetermined timing. One end of each of the piezoelectric elements PZ1 to PZN is an individual electrode and is connected to the first drive waveform generation circuit 204 and the second drive waveform generation circuit 205. The individual electrode is set to the drive waveform potential (Vcom) generated by either the first drive waveform generation circuit 204 or the second drive waveform generation circuit 205. The other end of each of the piezoelectric elements PZ1 to PZN is connected to a common electrode (com) that is set to a ground potential (GND). The common electrode (com) is common to the piezoelectric elements PZ1 to PZN.

Each of the piezoelectric elements PZ1 to PZN is driven by a potential (Vcom−com) between the individual electrode (Vcom) and the common electrode (com). The common electrode (com) has wiring resistance between adjacent piezoelectric elements. The current increases in proportion to the number of piezoelectric elements driven at the same time, and a potential variation occurs.

Typically, each piezoelectric element is driven by one type of drive signal generated by a drive waveform generation circuit having one drive waveform. On the other hand, the inkjet printer 1 according to the first embodiment selectively use a total of two types of drive signals, i.e., the first drive signal generated by the first drive waveform generation circuit 204 and the second drive signal generated by the second drive waveform generation circuit 205, to drive the piezoelectric elements PZ1 to PZN.

Influence of common potential variation caused by drive signals

Here, it is assumed that each of the piezoelectric elements PZ1 to PZN is driven by the drive signal generated by the first drive waveform generation circuit 204, and then each of the piezoelectric elements PZ1 to PZN is driven by the second drive signal generated by the second drive waveform generation circuit 205. In such a case, the influence of the first drive signal on the common electrode (com) greatly appears, and an unintended variation in the common potential adversely affects the driving of the piezoelectric elements PZ1 to PZN by the second drive signal.

Figure 6:
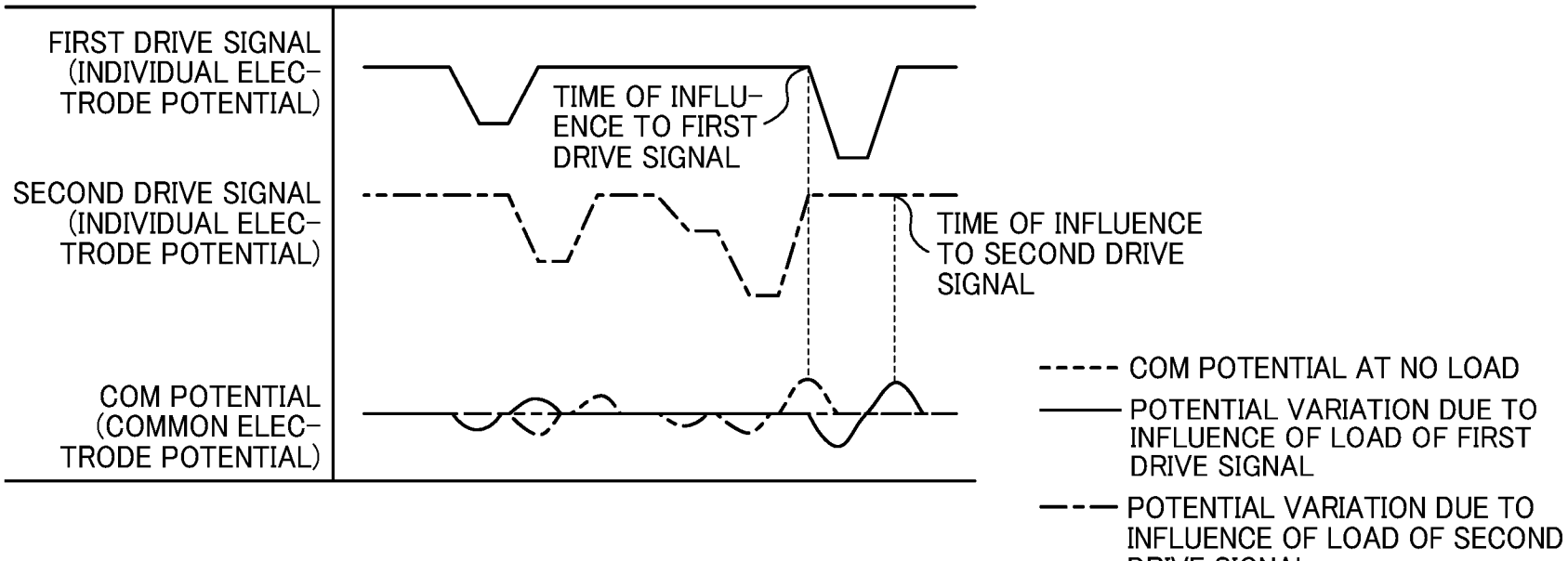
FIG. 6 is a diagram illustrating the influence of a first drive signal on a common electrode of each piezoelectric element.

FIG. 6 is a diagram illustrating the influence of the first drive signal on the common electrode (com). In FIG. 6, when a large number of piezoelectric elements PZ1 to PZN are driven by the first drive signal during one printing timing, a large amount of current caused by the first drive signal flows through the common electrode (com).

The potential of the common electrode (com) changes at the time corresponding to the rising (charging) and falling (discharging) of the first drive signal, and reaches the maximum potential at the slope end time of the rising shape. This is also true when a large number of piezoelectric elements are driven by the second drive signal.

When drive signals having different drive waveforms between the individual electrodes (between Vcoms) are supplied, the time of change of the common electrode potential due to each drive waveform is different between the first drive signal and the second drive signal. Accordingly, the variation of the common electrode potential caused by each drive signal affects each drive signal.

In other words, when the time of the potential variation caused by the first drive signal overlaps the discharge control timing by the second drive signal, the second drive signal is affected by the potential variation caused by the first drive signal. This affects the discharge control of the piezoelectric element driven by the second drive signal. Similarly, the potential variation of the common electrode caused by the second drive signal also affects the discharge control by the first drive signal.

Timing Control of Drive Signals

Figure 7:
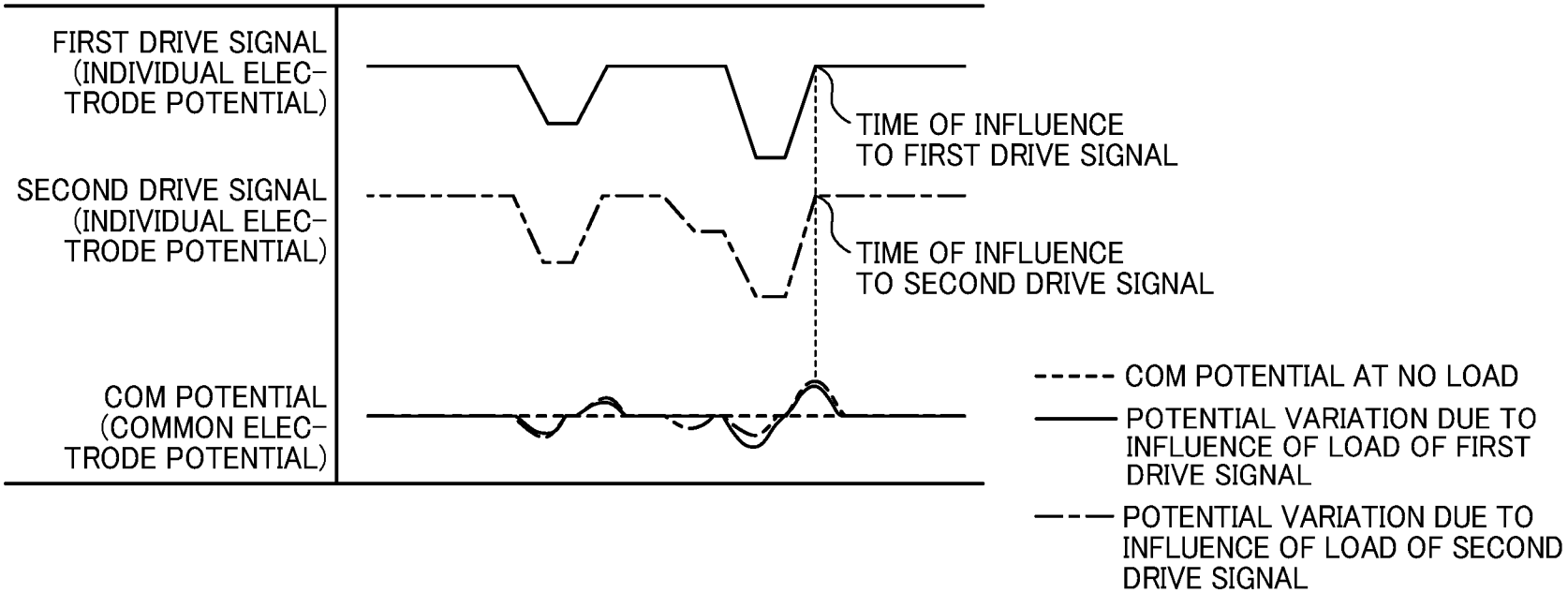
FIG. 7 is a diagram illustrating generation timings of a first drive signal and a second drive signal.

For this reason, in the inkjet printer 1 according to the first embodiment, in order to make the influence of each drive signal on the common electrode constant, as illustrated in FIG. 7, the generation timing of each drive signal is controlled so that the time at which the drive signals influence each other is the same time. When the rising shapes of the drive signals are generated at the same time, the time at which the potential of the common electrode is changed by each drive signal is the same for each drive signal.

In other words, when the time of the potential variation caused by the first drive signal is adjusted to the time at which the potential variation also occurs in the second drive signal, the time at which the second drive signal is affected by the potential variation does not change. Accordingly, the discharge control of the piezoelectric element driven by the second drive signal is not affected. In the opposite case, since the time at which the first drive signal is affected by the potential variation does not change, the discharge control of the piezoelectric element driven by the first drive signal is not affected.

Deviation of Load Between Drive Waveform Generation Circuits

Figure 8:
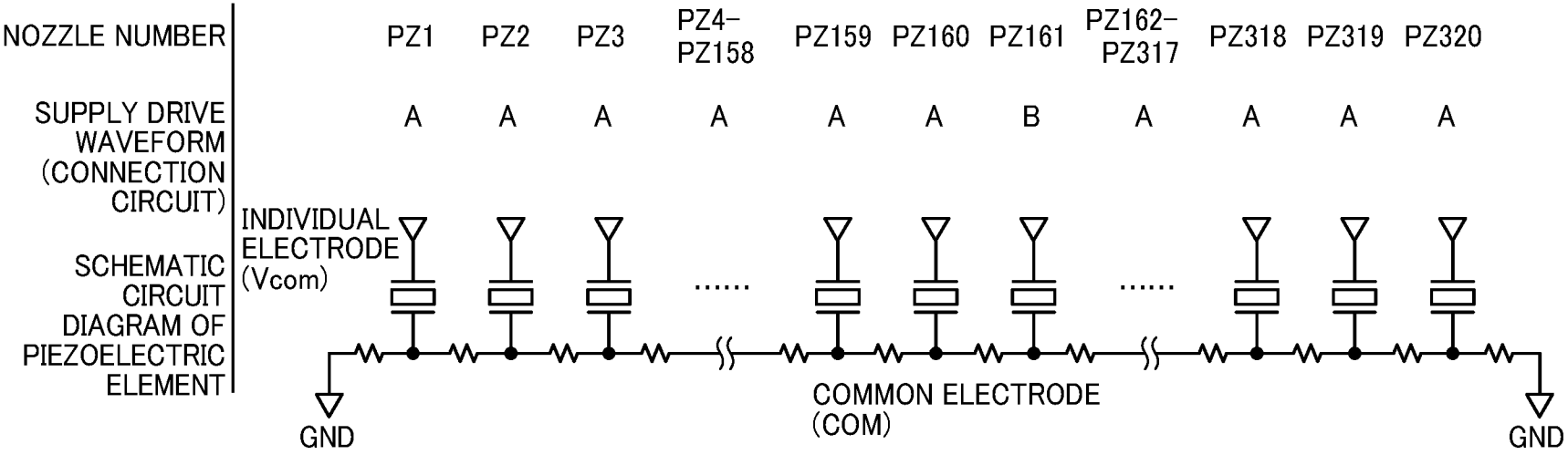
FIG. 8 is a diagram illustrating a deviation in load on a first drive waveform generation circuit.

Next, a description is given of a case in which the load is biased between the first drive waveform generation circuit 204 and the second drive waveform generation circuit 205. FIG. 8 is a diagram illustrating an example in which the first drive waveform generation circuit 204 has a high load. In the example of FIG. 8, the recording head 102 includes, for example, piezoelectric elements PZ1 to PZ320 that control discharge of ink from 320 nozzles. In this example, drive waveforms are simultaneously supplied to the piezoelectric elements PZ1 to PZ320 at one printing timing.

In the example of FIG. 8, the first drive waveform generation circuit 204 supplies the first drive signal to a total of 319 piezoelectric elements including the piezoelectric elements PZ1 to PZ160 and the piezoelectric elements PZ162 to PZ320, among the 320 piezoelectric elements, and is on the high load side. On the other hand, the second drive waveform generation circuit 205 supplies a drive waveform only to the piezoelectric element PZ161, which is the remaining one piezoelectric element, and is on the low load side. The potential variation of the common electrode (com) is caused by the first drive signal supplied by the first drive waveform generation circuit 204.

For example, the individual electrode (Vcom) of the piezoelectric element PZ159 is connected to the first drive waveform generation circuit 204. The piezoelectric element PZ159 is affected by the potential variation of the common electrode, which is caused by the first drive signal generated by the first drive waveform generation circuit 204. Both of the piezoelectric element PZ158 and the piezoelectric element PZ160 adjacent to the left side and the right side of the piezoelectric element PZ159 have high load.

The individual electrode (Vcom) side of the piezoelectric element PZ161 is connected to the second drive waveform generation circuit 205. However, since the individual electrode (Vcom) side is connected to the piezoelectric element PZ159 via the common electrode (com), the piezoelectric element PZ161 is affected by the same potential variation on the common electrode side as in the piezoelectric element PZ159. Accordingly, the piezoelectric element PZ161 has a high load on the common electrode side and a low load on the individual electrode (Vcom) side. Since the load states of the respective electrodes (Vcom and com) are unbalanced, the piezoelectric element PZ161 is likely to be affected by the drive waveform distortion due to the potential variation on the common electrode (com) side.

Also in the piezoelectric element PZ161 to which the second drive signal from the second drive waveform generation circuit 205 is supplied, the potential variation on the common electrode side is affected by the first drive signal of the first drive waveform generation circuit 204. Note that FIG. 8 illustrates an example in which the first drive waveform generation circuit 204 has a high load. However, even when the second drive waveform generation circuit 205 has a high load, the influence on the common electrode (com) side is similar to the influence described above.

Waveform and Timing Adjustment of Drive Signals

Figure 9:
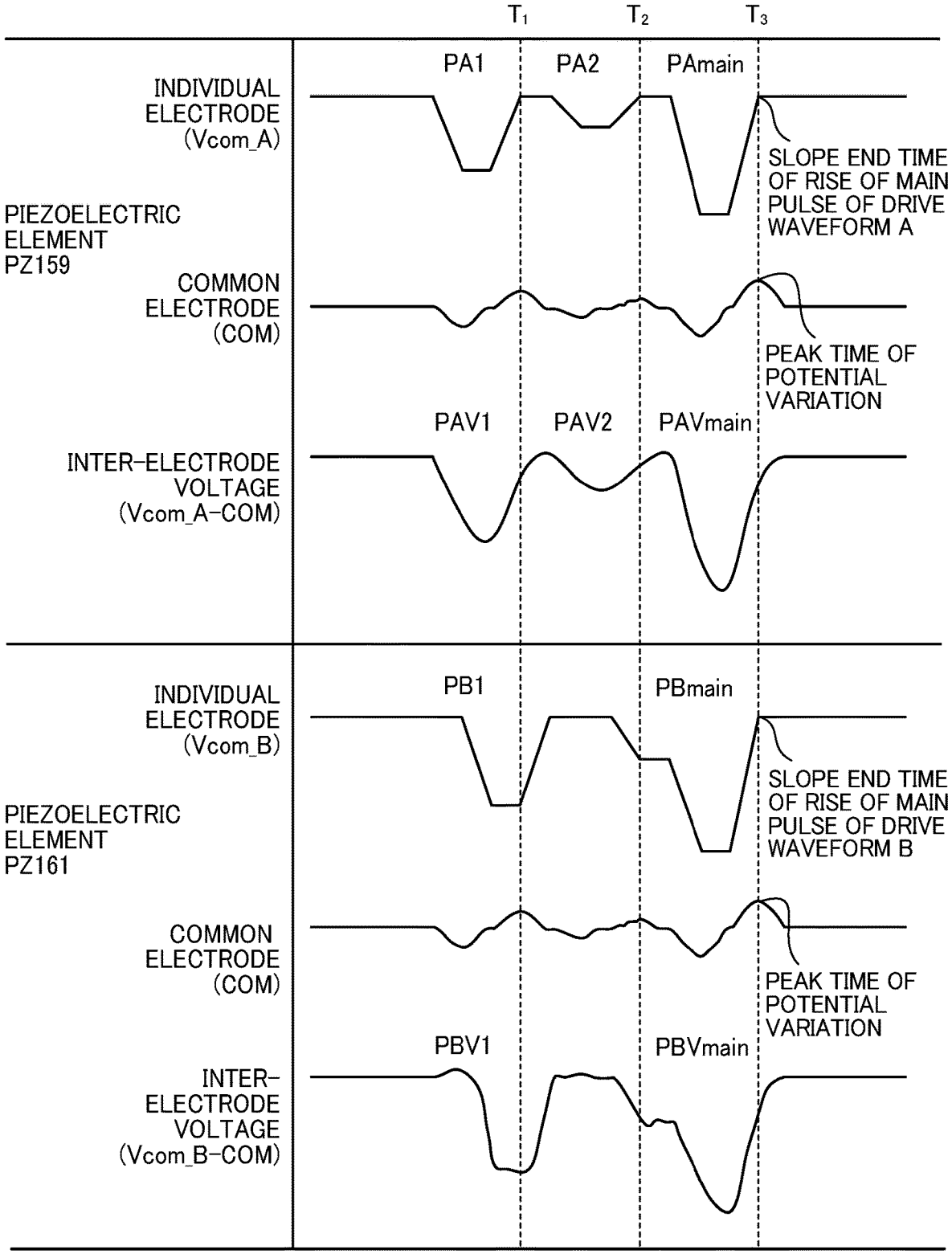
FIG. 9 is a diagram illustrating waveforms and supply timings of drive signals supplied to a high-load piezoelectric element and a low-load piezoelectric element.

Next, FIG. 9 is a diagram illustrating waveforms and supply timings of drive signals supplied to the piezoelectric element PZ159 and the piezoelectric element PZ161 described above. In FIG. 9, the first drive signal generated by the first drive waveform generation circuit 204 has a multi-pulse configuration including pulses of three waveforms PA1, PA2, and PAmain. Among the pulses, the main pulse is PAmain. Similarly, the second drive signal generated by the second drive waveform generation circuit 205 has a multi-pulse configuration including PB1 and PBmain. Among the pulses, the main pulse is PBmain.

As in the example of FIG. 8, when a large number of piezoelectric elements are driven by the first drive signal during one printing timing, a large amount of current caused by the first drive signal flows through the common electrode (com). As illustrated in FIG. 9, the potential of the common electrode (com) varies at the time corresponding to the rise or fall of the first drive signal, and distortion corresponding to the varied potential occurs in the waveform of the voltage (inter-electrode voltage) applied to the piezoelectric element. In the example of FIG. 9, the potential of the common electrode (com) varies at the time of charging or discharging of the first drive signal.

In the voltage (Vcom−com) between the individual electrode and the common electrode of the piezoelectric element PZ159, distortion occurs in a form in which dullness occurs in rising edges and falling edges of PAV1, PAV2, and PAVmain.

The same variation occurs in the common electrode (com) of the piezoelectric element PZ161. However, the pulse waveforms PB1 and PBmain of the drive signal on the individual electrode (Vcom) side are different from the pulse waveforms PA1, PA2, and PAmain of the first drive signal. Accordingly, the distortion generated in the voltage (Vcom−com) between the individual electrode and the common electrode of the piezoelectric element PZ161 also has a shape different from the shape of the distortion generated in the voltage between the individual electrode and the common electrode of the piezoelectric element PZ159.

In other words, since the rising edges and the falling edges of the pulses PB1 and PBmain of the second drive signal are affected by distortion at portions different from the affected portions of the first drive signal, a difference occurs in the pulse shape of the drive signal supplied to the piezoelectric element between the first drive waveform generation circuit 204 and the second drive waveform generation circuit 205, thus causing a discharge failure of the nozzle.

Since the variation of the potential generated in the common electrode (com) is generated by the current involving with the charging and discharging of the piezoelectric element, the potential is at maximum or minimum at the end time of the slope of the pulse. The potential variation width is proportional to the amount of current. Accordingly, the potential variation amount is at maximum at the end time of the slope of the pulse having the maximum amplitude and the maximum inclination among the above-described multi-pulses.

In the multi-pulse design, among the plurality of pulses, the main pulse is a pulse for determining the ink discharge speed and discharging an ink droplet at the maximum speed. Accordingly, the main pulse has a large inclination and a maximum current amount. Therefore, when the main pulse is affected by the distortion described above, the discharge accuracy is greatly affected. In addition, the influence of the distortion on the discharge of the ink droplet appears more largely on the rising shape in the push-out direction of the ink droplet than in the pull-in direction of the ink droplet.

For this reason, as illustrated in FIG. 9, the inkjet printer 1 according to the first embodiment matches the slope end times of the rising edges of the pulse waveforms of the first drive signal and the second drive signal generated by the first drive waveform generation circuit 204 and the second drive waveform generation circuit 205, respectively. Such a configuration allows the piezoelectric element driven by the first drive signal and the piezoelectric element driven by the second drive signal to be affected by distortion at the same timing. Thus, the difference between the circuits of the first drive waveform generation circuit 204 and the second drive waveform generation circuit 205 can be reduced. In particular, matching the time (timing) of the main pulse can greatly improve the discharge operation of the nozzles of the recording head 102.

In other words, in FIG. 9, the slope end time of the rising edge of the main pulse PAmain of the first drive signal, which is the pulse having the largest potential variation of the common electrode (com), and the slope end time of the rising edge of the main pulse PBmain of the second drive signal are matched at the time T3. Such a configuration can reduce the influence of distortion generated in the voltage (Vcom−com) between the individual electrode and the common electrode.

Since the amount of change in potential is small at the slope end times T1 and T2 of the rising of the sub-pulses PA1 and PA2, the influence on the discharge operation of the nozzle is small. Also for the second drive signal, because of the time of the sub-pulse PB1, the influence on the discharge operation of the piezoelectric element PZ161 is small. When the distortion due to the sub-pulse affects the discharge speed, the influence can be reduced by shifting the time of the sub-pulse or the main pulse by a predetermined amount.

Advantageous Effect of First Embodiment

As is apparent from the above description, in the inkjet printer 1 according to the first embodiment, the electrode on one side of each piezoelectric element of the recording head 102 is an individual electrode, and the terminal on the other side is a common electrode. In addition, a first drive signal that is a multi-pulse for driving each piezoelectric element is generated by the first drive waveform generation circuit 204, and a second drive signal that is a multi-pulse having a multi-pulse waveform different from the first drive signal is generated by the second drive waveform generation circuit 205. Then, the slope end time of the rise of the main pulse of the first drive signal and the slope end time of the rise of the main pulse of the second drive signal are matched and supplied to each piezoelectric element to drive the piezoelectric element.

Such a configuration can reduce electrical interference that occurs when each piezoelectric element is driven by two different types of pulse waveforms without requiring processing of the piezoelectric elements and without increasing the circuit scale, thus enhancing print quality.

Second Embodiment

Next, an inkjet printer according to a second embodiment is described. In the case of the inkjet printer 1 according to the first embodiment described above, each piezoelectric element is driven by a total of two types of drive signals, i.e., the first drive signal and the second drive signal. The inkjet printer according to the second embodiment is an example in which each piezoelectric element is driven by a total of four types of drive signals. Hereinafter, the difference between the first embodiment and the second embodiment is mainly described, and redundant descriptions is omitted.

Figure 10:
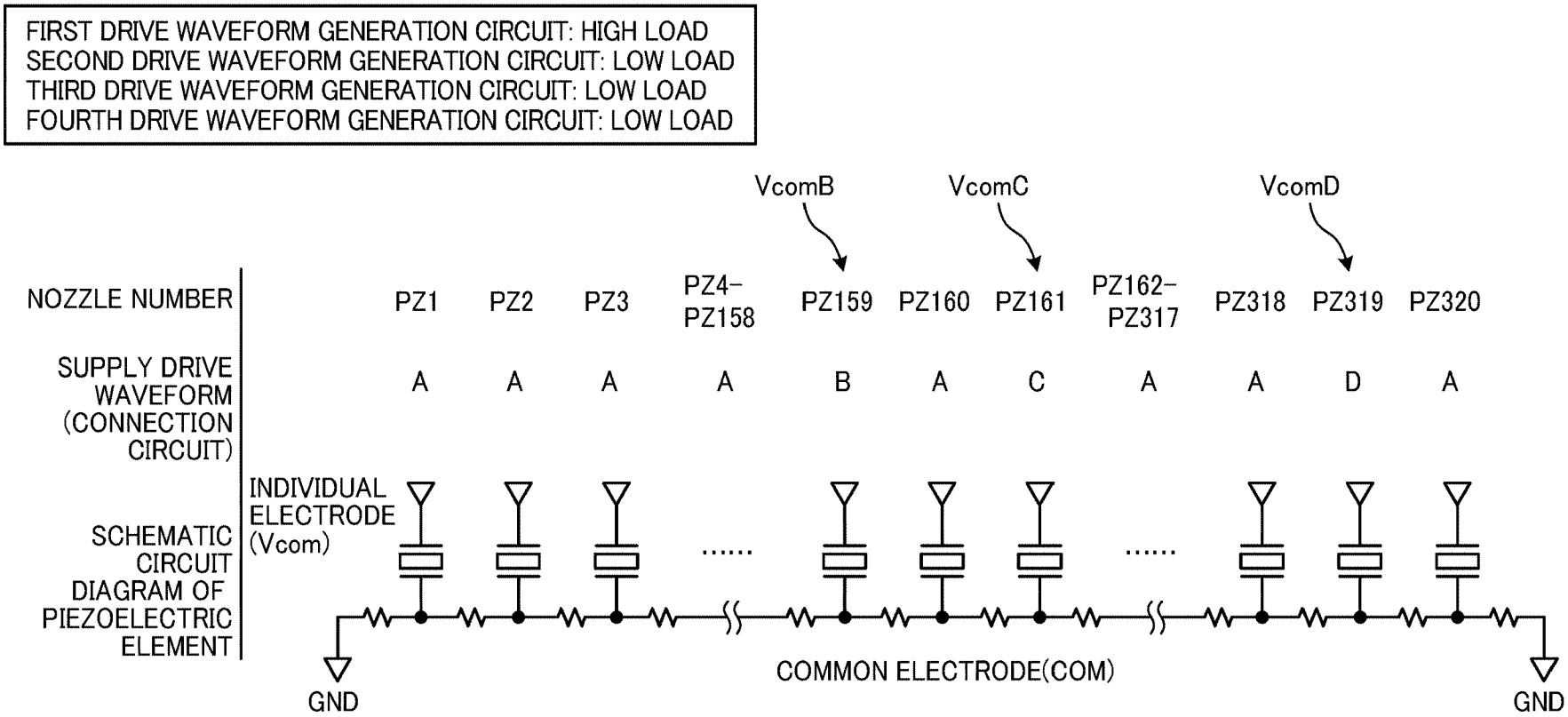
FIG. 10 is a diagram illustrating an inkjet printer according to a second embodiment in which each piezoelectric element is driven by various types of drive signals.

As illustrated in FIG. 10, the inkjet printer according to the second embodiment includes a first drive waveform generation circuit A, a second drive waveform generation circuit B, a third drive waveform generation circuit C, and a fourth drive waveform generation circuit D. The drive waveform generation circuits A, B, C, and D, respectively, generate drive signals A, B, C, and D having different pulse waveforms. The time of the main pulse of each of the generated drive signals A, B, C, and D is also different.

Although the bias of the load is different for each print timing based on the image information, the drive signal having the largest influence on the common electrode (com) among the drive signals A, B, C, and D in one print timing is a drive signal having the highest load (connected to many piezoelectric elements) at the same timing.

FIG. 10 illustrates an example in which there is a deviation in loads (the number of piezoelectric elements) to which the drive signals A, B, C, and D are supplied. In other words, the drive signal A is connected to the largest number of piezoelectric elements (high load), and each of the drive signals B, C, and D is connected to one piezoelectric element (low load). In such a case, the pulse waveforms of the drive signals B, C, and D are affected by the pulse waveform of the drive signal A having a high load via the common electrode (com).

In the example of FIG. 10, the drive signal A (high load) connected to the largest number of piezoelectric elements is an example of the drive signal having the largest influence. The drive signals B, C, and D other than the drive signal A (in other words, the drive signals other than the drive signal connected to the largest number of piezoelectric elements) are examples of the drive signals other than the drive signal having the largest influence.

As described above, when the plurality of drive signals have different pulse waveforms and the times of the main pulses are also different, the drive signals B, C, and D are differently affected by the drive signal A. At this time, matching the time of the main pulse of each of the drive signals B, C, and D with the drive signal A can uniform the influence of the common electrode (com) on the drive signals B, C, and D.

Time Adjustment of Main Pulse

Figure 11:
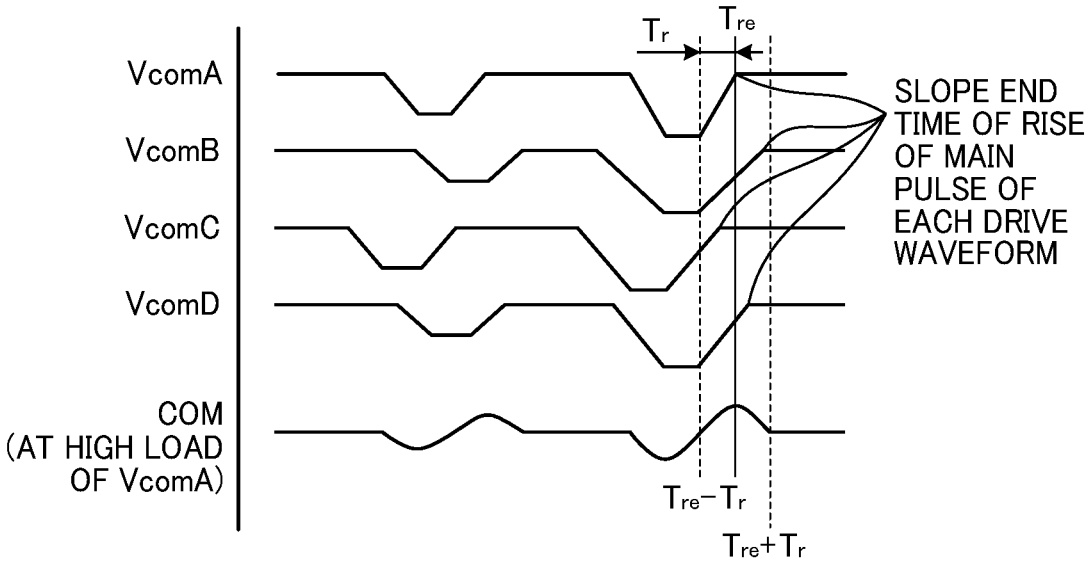
FIG. 11 is a diagram illustrating time adjustment of main pulses of the drive signals used in the inkjet printer according to the second embodiment.

FIG. 11 illustrates an example in which the time of the main pulse of each of the drive signals A, B, C, and D is matched. In FIG. 11, the time required from the start of the slope of the rising edge of the main pulse of the drive signal A to the end of the slope is denoted by "Tr", and the time of the end of the slope is denoted by "Tre". Typically, the time Tr is equal to the time during which the common electrode (com) is charged and varies from a normal potential to a peak potential. The slope end time Tre is equal to the time at which the common electrode (com) has the peak potential. The time required for the common electrode (com) to be discharged and return from the peak potential to the normal potential is often equivalent to the time Tr.

In other words, in the potential variation of the common electrode (com) tr, the potential variation of the common electrode (com) occurs due to the inclination of the rising edge of the main pulse of the drive signal A, and the potential variation is at maximum at the slope end time Tre that is the slope end portion of the main pulse. Also in the other drive signals B, C, and D, the respective drive waveforms have similar influences on the common electrode (com).

Figure 12:
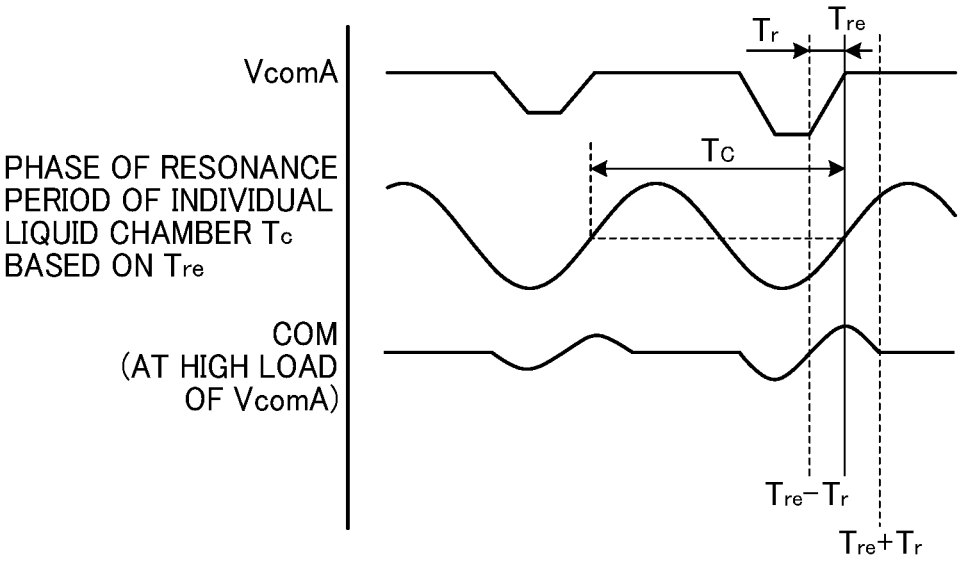
FIG. 12 is a diagram illustrating a relation between a slope end time of a drive signal selected from among various types of drive signals and a resonance period of an individual liquid chamber.

FIG. 12 is a diagram illustrating the relation between the slope end time Tre of the drive signal A and the resonance period Tc of the individual liquid chamber 156. Typically, the drive waveform is designed to correspond to the phase of push-pull of the resonance period Tc of the individual liquid chamber 156. The time "Tr" required from the start of the slope of the rising of the main pulse of the drive signal A to the end of the slope and the slope end time "Tre" are designed to be optimum times with respect to the phase of the resonance period Tc of the individual liquid chamber 156.

When there are a plurality of drive signals (Vcom) as in the case of the drive signals A, B, C, and D, the time at which the potential variation of the common electrode (com) is at maximum in the drive waveform for each drive signal is set to the same time. Accordingly, the time at which the potential variation of the common electrode (com) with respect to the phase of the resonance period Tc of the individual liquid chamber 156 is at maximum can also be set to the same time.

As the time at which the potential variation of the common electrode (com) is at maximum with respect to the phase of the resonance period Tc of the individual liquid chamber 156 is closer to the opposite phase, the influence on the ink discharge of the nozzle increases, and the influence is smaller in Tre±Tr (i.e., slope end time±time required from the slope start of the rising of the main pulse to the slope end). Therefore, setting the slope end time of the main pulse of each of the drive signals B, C, and D within the range of the slope time Tre±Tr of the drive signal A can reduce the relative influences between the drive signals even when any drive signal has a high load.

As illustrated in FIG. 11, when the time is adjusted within the range of Tre±Tr, a reference drive signal (in this case, the drive signal A) is selected from a plurality of drive signals, for example, by setting the slope end time of the drive signal A to Tre among the drive signals A, B, C, and D. The drive signal A selected as the reference drive signal has the smallest time difference in the slope end time from the other drive signals B, C, and D. For this reason, for example, the drive signal A having a waveform shape in which the largest influence on the common electrode (com) is set as a reference. Even in a case in which a deviation occurs in the load for any of the drive signals according to the print timing, the influence of the variation of the common electrode (com) among the drive signals A, B, C, and D can be reduced.

The drive signal (Vcom) having the largest influence on the common electrode (com) is a drive signal (Vcom) having the largest influence on the common electrode (com) when the same number of piezoelectric elements PZ are driven. In other words, it is preferable to select the drive signal (Vcom) having the main pulse with the largest potential variation width of the common electrode (com) per unit time, as the above-described reference drive signal.

Advantageous Effect of Second Embodiment

As is apparent from the above description, even when each piezoelectric element is driven by a large number of drive signals such as four drive signals as in the inkjet printer according to the second embodiment, similarly with the above-described first embodiment, the inkjet printer according to the second embodiment can reduce electrical interference generated when each piezoelectric element is driven by two different pulse waveforms, without requiring processing of the piezoelectric elements and without increasing the circuit scale, and improve print quality.

Finally, the above-described embodiments are presented as examples and are not intended to limit the scope of the present disclosure. The above-described novel embodiments can be implemented in other various forms, and various omissions, replacements, and changes can be made without departing from the scope of the disclosure. It is therefore to be understood that within the scope of the disclosure, the embodiments may be practiced otherwise than as specifically described herein. For example, elements and/or features of different illustrative embodiments may be combined with each other and/or substituted for each other within the scope of the present disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus, comprising:

piezoelectric elements each with a common electrode on one side and an individual electrode on another side;

nozzles configured to discharge droplets; and circuitry configured to determine driven piezoelectric elements to be driven among the piezoelectric elements at a print timing based on image information to be printed, select a drive signal from a plurality of drive signals per driven piezoelectric element at the print timing, and simultaneously supply the selected drive signal to individual ones of the driven piezoelectric elements via the individual electrode to discharge the droplets through the nozzles to form an image, the drive signals each comprise a different pulse waveform having a main pulse that rises in a slope shape during a rising time and finishes rising at an end time, the circuitry further configured to:

generate the plurality of drive signals so that end times of a group of less influential drive signals other than a most influential drive signal among the plurality of drive signals fall within a range defined as being within a threshold amount of time of an end of the rising time of the main pulse of the most influential drive signal, and the end times are staggered across the range; and select the selected drive signal from the plurality of drive signals per driven piezoelectric element at the print timing based on the image information.

2. The image forming apparatus according to claim 1, wherein the main pulse is a pulse that causes a largest width of potential variation in the common electrode among a plurality of pulses in a drive signal.

3. An image forming apparatus, comprising:

piezoelectric elements each with a common electrode on one side and an individual electrode on another side;

nozzles configured to discharge droplets; and circuitry configured to determine driven piezoelectric elements to be driven among the piezoelectric elements at a print timing based on image information to be printed, select a drive signal from a plurality of drive signals per driven piezoelectric element at the print timing, and simultaneously supply the selected drive signal to individual ones of the driven piezoelectric elements via the individual electrode to discharge the droplets through the nozzles to form an image, the drive signals each comprise a different pulse waveform having a main pulse that rises in a slope shape during a rising time and finishes rising at an end time, the circuitry further configured to:

generate the plurality of drive signals so that end times of a group of drive signals other than a reference drive signal that drives a largest number of the driven piezoelectric elements among the plurality of drive signals fall within a range defined as being within a threshold amount of time of an end of the rising time of the main pulse of the reference drive signal, and the end times are staggered across the range; and select the selected drive signal from the plurality of drive signals per driven piezoelectric element at the print timing based on the image information.

4. The image forming apparatus according to claim 3, wherein the main pulse is a pulse that causes a largest width of potential variation in the common electrode among a plurality of pulses in a drive signal.

5. A non-transitory storage medium storing computer-readable program code for causing an image forming apparatus including piezoelectric elements each with a common electrode on one side and an individual electrode on another side and nozzles configured to discharge droplets, to execute a droplet discharge control method:

the method comprising:

determining driven piezoelectric elements to be driven among the piezoelectric elements at a print timing based on image information to be printed;

selecting a drive signal from a plurality of drive signals per driven piezoelectric element at the print timing; and simultaneously supplying the selected drive signal to individual ones of the driven piezoelectric elements via the individual electrode to discharge the droplets through the nozzles to form an image, wherein the drive signals each comprise a different pulse waveform having a main pulse that rises in a slope shape during a rising time and finishes rising at an end time;

wherein the method further comprises generating the plurality of drive signals so that end times of a group of less influential drive signals other than a most influential drive signal among the plurality of drive signals fall within a range defined as being within a threshold amount of time of an end of the rising time of the main pulse of the most influential drive signal, and the end times are staggered across the range;

wherein selecting the selected drive signal comprises selecting the selected drive signal from the plurality of drive signals per driven piezoelectric element at the print timing based on the image information.

6. The non-transitory storage medium according to claim 5, wherein the main pulse is a pulse that causes a largest width of potential variation in the common electrode among a plurality of pulses in a drive signal.

7. The image forming apparatus according to claim 1, wherein pulse waveforms of the plurality of drive signals each include a sub-pulse prior to the main pulse, and the sub-pulse rises in a slope shape, and end times of sub-pulses of the less influential drive signals are different from an end time of a sub-pulse of the most influential drive signal.

8. The image forming apparatus according to claim 1, wherein the threshold amount of time comprises a time from a start of the slope of the rising edge of the main pulse to an end of the slope.

* * * * *